US006315179B1

(12) United States Patent
Hillis

(10) Patent No.: US 6,315,179 B1
(45) Date of Patent: Nov. 13, 2001

(54) TOOL HARNESS

(76) Inventor: James C. Hillis, 1628 Northwestern Rd., Longmont, CO (US) 80503

( * ) Notice: Subject to any disclaimer, the term of this patent is extended or adjusted under 35 U.S.C. 154(b) by 0 days.

(21) Appl. No.: 09/494,736

(22) Filed: Jan. 31, 2000

Related U.S. Application Data

(60) Provisional application No. 60/118,884, filed on Feb. 5, 1999.

(51) Int. Cl.[7] ..... A45F 5/00

(52) U.S. Cl. ..... 224/268; 224/200; 224/600; 224/607

(58) Field of Search ..... 224/268, 200, 224/600, 607, 621, 259, 260, 904, 911, 646

(56) References Cited

U.S. PATENT DOCUMENTS

| | | | | |
|---|---|---|---|---|
| 1,660,740 | | 2/1928 | Bailey . | |
| 2,273,136 | | 2/1942 | Orech et al. . | |
| 2,441,115 | | 5/1948 | Lambert . | |
| 2,718,988 | | 9/1955 | Potts . | |
| 2,915,233 | | 12/1959 | Moomaw . | |
| 3,366,293 | | 1/1968 | Fyke . | |
| 3,862,709 | | 1/1975 | Roshaven . | |
| 3,963,156 | | 6/1976 | Perrin . | |
| 4,498,613 | | 2/1985 | Donahue et al. . | |
| 4,768,689 | | 9/1988 | Davis . | |
| 4,773,577 | | 9/1988 | Mikula . | |
| 5,009,022 | * | 4/1991 | McCoy | 42/94 |
| 5,016,797 | | 5/1991 | Rowledge . | |
| 5,246,153 | * | 9/1993 | Beletsky | 224/911 X |
| 5,246,154 | | 9/1993 | Adams et al. . | |
| 5,263,618 | * | 11/1993 | Talavera | 224/206 |
| 5,687,891 | * | 11/1997 | Beletsky | 224/911 X |
| 5,775,558 | * | 7/1998 | Montalbano | 224/911 X |
| 5,894,976 | * | 4/1999 | Harper | 224/911 X |
| 6,065,658 | * | 5/2000 | Hashimoto | 224/904 X |
| 6,149,042 | * | 11/2000 | Rassias | 224/911 X |

* cited by examiner

*Primary Examiner*—Stephen K. Cronin
*Assistant Examiner*—Maerena W. Brevard
(74) *Attorney, Agent, or Firm*—Rick Martin; Patent Law Offices of Rick Martin, P.C.

(57) ABSTRACT

The present invention has a single harness strap loop, which is placed diagonally across the body from one shoulder to the opposite hip, similar to bandoleer. At the hip an open hook is provided. This hooks on to the ring provided at the base of most power tools. A lanyard is attached to the harness at the back and has a clip at the other end. The clip also attaches to the ring on the power tool. The lanyard can be made of stretchable cord to reduce the jerk on the wearer if the tool falls. A clip is attached next to the hook to attach the harness to a belt or belt loop on the wearer to prevent rotation of the harness. The harness is adjustable to allow for sizing.

9 Claims, 3 Drawing Sheets

TOOL HARNESS

CROSS-REFERENCE TO RELATED APPLICATION

This application is a non-provisional application claiming the benefits of provisional application No. 60/118,884 filed Feb. 5, 1999.

FIELD OF INVENTION

The present invention relates to body harnesses for power tools.

BACKGROUND OF THE INVENTION

It is well known in the art to use a variety of tool belts to hold hand tools and power tools. The power tools, especially the drill, can add substantial weight. It is not uncommon for a standard tool belt to weigh up to 70 pounds with all the tools in it. All of this weight resting on the hips can cause back problems for the wearer.

Another problem with standard tool belts is that it can be hard to get the power tools in and out of the belt with only one hand. It is not uncommon to be holding a board in place with one and to need a drill to attach the board. It is also very common for the drill not to get put back in the tool belt when finished because the drill is hard to get back in the tool belt. This can lead to the drill or other power tool getting knocked over, which can lead to damaged or broken tools. All of these problems are amplified while working on a ladder.

It is desirable to have the weight of the power tool off of the hips and situated so that the tool can be accessed with only one hand. It is also desirable to have a safety line attached to the tool so that the tool will not hit the ground if knocked over. The present invention solves these problems with a shoulder strap having a hip level clip in addition to a tether for catching a dropped tool.

A number of patents have addressed shoulder harness for a variety of objects. Some are listed below.

U.S. Pat. No. 1,660,740 (1928) to Bailey discloses a hanger with a strap to go around the neck. It is adjustable and has an open hanger.

U.S. Pat. No. 2,441,115 (1948) to Lambert discloses a shoulder harness with a clip. The harness goes over both shoulders and around the chest.

U.S. Pat. No. 2,273,136 (1942) to Orech et al. discloses a hanger with a strap to go around the neck. It is adjustable and has an open hanger.

U.S. Pat. No. 2,718,988 (1955) to Potts discloses a shoulder harness with hangers off both shoulders.

U.S. Pat. No. 2,915,233 (1959) to Moomaw discloses a gun shoulder harness. The harness is adjustable with an open hook.

U.S. Pat. No. 3,366,293 (1966) to Fyke discloses a guitar strap which goes around the neck and is adjustable with an open hook.

U.S. Pat. No. 3,862,709 (1975) to Roshaven discloses a cable holder with a shoulder strap and a hook to hold the strap at the belt of the wearer.

U.S. Pat. No. 3,963,156 (1976) to Perrrin discloses a waist mounted, gun cradle with two open hooks to hold the gun.

U.S. Pat. No. 4,498,613 (1985) to Donahue discloses a shoulder harness with a lanyard to hold a baby bottle or baby toy. The lanyard has an elastic loop for attachment of the items.

U.S. Pat. No. 4,768,689 (1988) to Davis discloses a shoulder sling with a hook on each end of a strap.

U.S. Pat. No. 4,773,577 (1988) to Mikula discloses a shoulder sling for a fire ax.

U.S. Pat. No. 5,016,797 (1991) to Rowledge discloses a shoulder harness which goes over both shoulders with two hooks in front. The hooks are slidably attached to the shoulder straps so the article does not have to be unhooked to be brought up to the user's face.

U.S. Pat. No. 5,246,154 (1993) to Adams et al. discloses an adjustable shoulder sling for a gun or bow. The article attaches to the harness with a loop and hook system.

None of these inventions is adapted to use as a harness for power tools that is easy to use and safe.

SUMMARY OF THE INVENTION

The primary aspect of the present invention is to provide an easy to access holster for a power tool.

Another aspect of the present invention is to move the weight of the power tool off the hips and on to the shoulders.

Another aspect of the present invention is to provide a harness that is easy to get in and out of.

Another aspect of the present invention is to provide a harness with a lanyard to attach the power tool to the harness.

Another aspect of the present invention is to provide a lanyard adapted to reduce the jerk on the wearer if the power tool does fall.

Another aspect of the present invention is to provide a harness that is easy to adjust.

Other aspects of this invention will appear from the following description and appended claims, reference being made to the accompanying drawings forming a part of this specification wherein like reference characters designate corresponding parts in the several views.

The present invention has a single harness strap loop, which is placed diagonally across the body from one shoulder to the opposite hip, similar to a bandoleer. At the hip an open hook is provided. This open hook receives the ring provided at the base of most power tools. A lanyard is attached to the harness at the back and has a clip at the other end. The clip also attaches to the ring on the power tool. The lanyard can be made of stretchable cord to reduce the jerk on the wearer if the tool falls. A clip is attached next to the hook to attach the harness to a belt or belt loop on the wearer to prevent rotation of the harness. The harness is adjustable to allow for sizing.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 1:
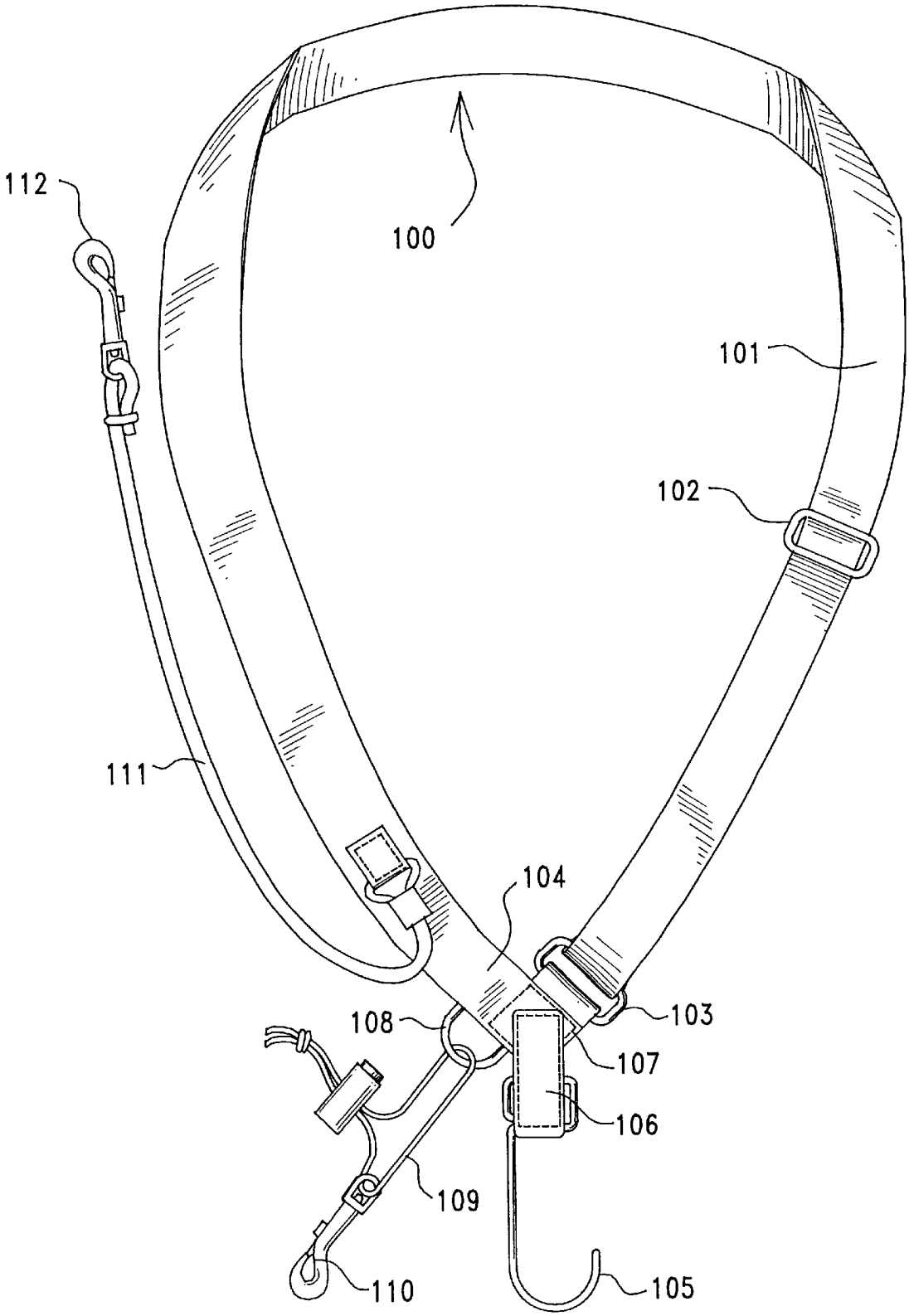
FIG. 1 is a front perspective view of the preferred embodiment.

Referring first to FIG. 1, the shoulder harness 100 has a harness strap 101. The harness strap 101 has a first end 104, which has adjustment loop 103 attached to said end, forming an attachment point 107. A second end (not shown) is fed through the adjustment loop 103 and attached to buckle 102, a standard sliding buckle in the preferred embodiment. A hook and loop fastener such as Velcro® or any similar devices could also be used to provide adjustability.

A hook 105 is attached with strap 106 to attachment point 107. Next to strap 106 is loop 108 with an adjustable strap 109 and belt clip 110.

Lanyard 111 is attached to the harness strap 101 behind loop 108. A tool clip 112 is attached to the other end of lanyard 111.

Figure 2:
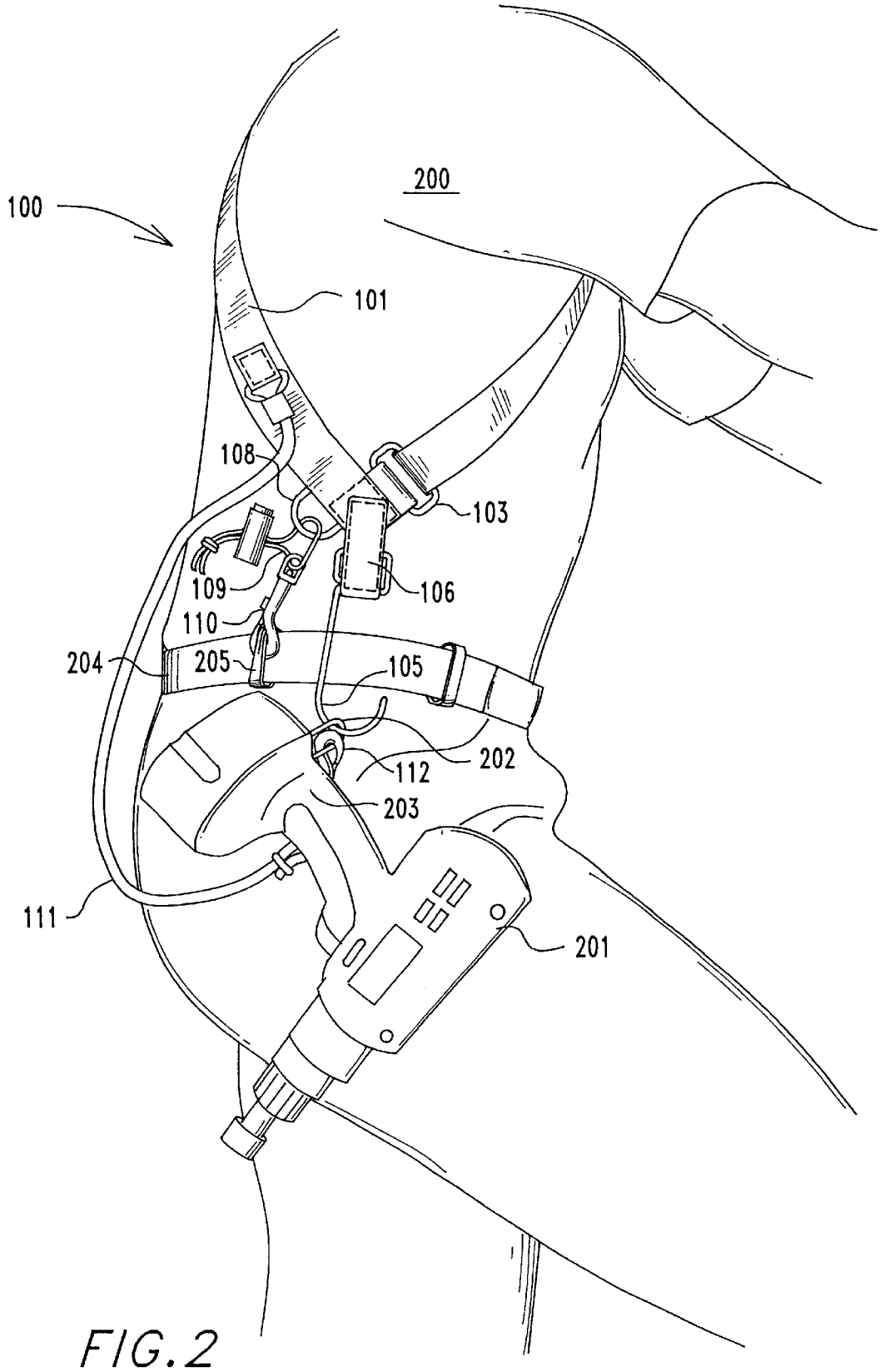
FIG. 2 is a side perspective view showing the harness on a wearer with a power drill.

As seen in FIG. 2, when the shoulder harness 100 is placed on wearer 200 the hook 105 is situated under the arm, about at the hip. The hook 105 is under the primary arm of the wearer and just above the hip for ease of access thereto. Belt clip 110 is attached to either belt 204 or belt loop 205. This prevents rotation of the shoulder harness 100 when the wearer 200 bends forward. This also reduces the bouncing and movement as the wearer 200 moves around.

Figure 3:
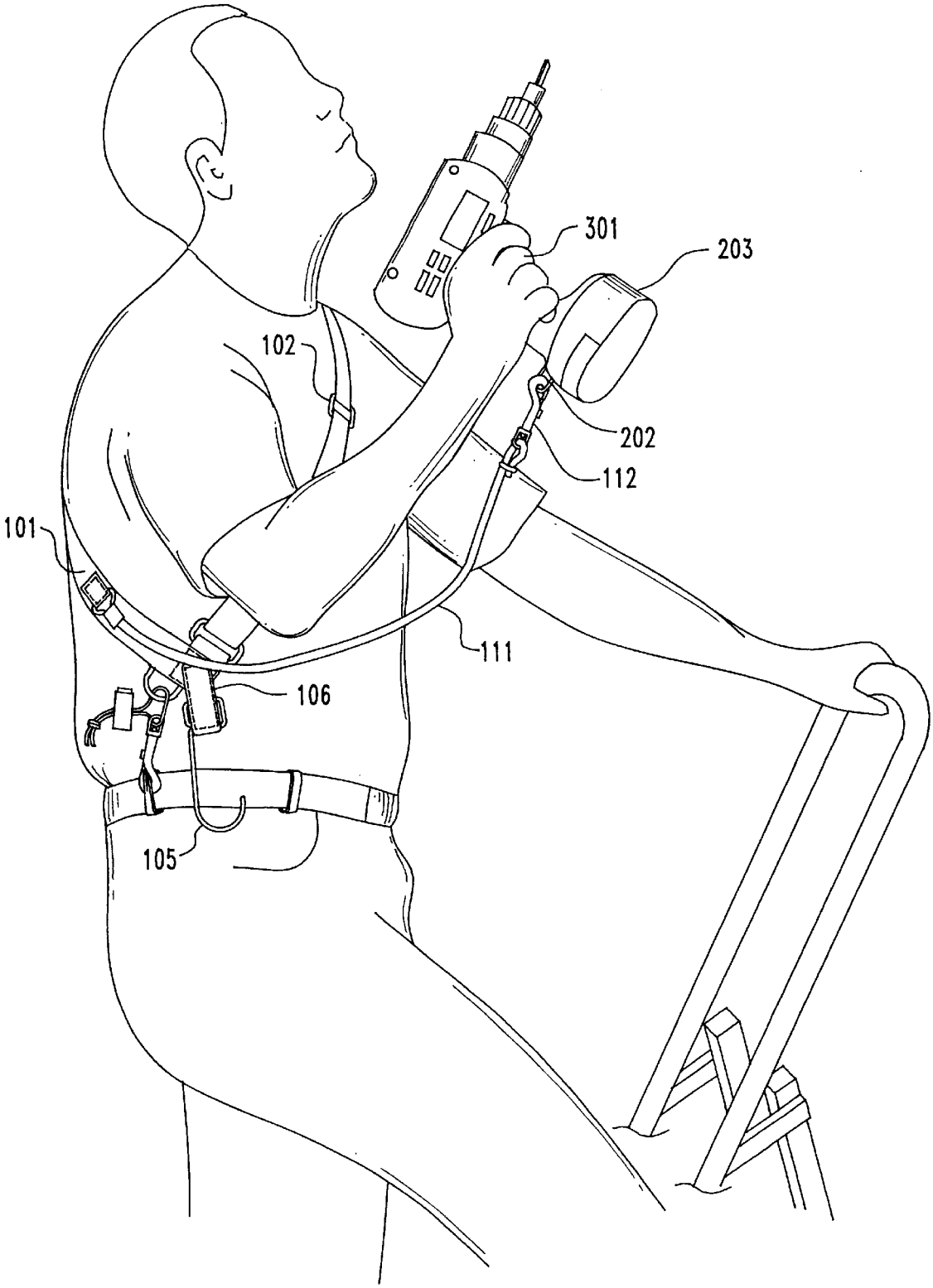
FIG. 3 shows the harness being worn while the drill is being used.

Power drill 201 has a ring 202 at the base 203. Ring 202 is slipped on to hook 105 so that the drill hangs at the hip. The wearer 200 is then free to move around. When the drill 201 is to be used the wearer 200 simply grasps the drill with the primary hand 301 and uses it, as shown in FIG. 3. Only one hand is needed to remove or replace the drill 201 on the hook 105.

The lanyard 111 is attached to the ring 202 with tool clip 112. The lanyard 111 is attached at the back of shoulder harness 100 so that the lanyard 111 is under the arm and out of the way.

In the preferred embodiment the lanyard 111 is made from stretchable cord, such as bungee cord, so that if the tool falls there is not a hard jerk on the wearer. This reduces the discomfort and reduces the chance of falling off a ladder or similar height.

Although the present invention has been described with reference to preferred embodiments, numerous modifications and variations can be made and still the result will come within the scope of the invention. No limitation with respect to the specific embodiments disclosed herein is intended or should be inferred.

I claim:

1. A tool holder comprising:

a shoulder harness having a lower apex near a user's hip;

a tool receiver attached to said apex suitable to support a power hand tool;

said shoulder harness consisting of a single shoulder sling functioning to hold the tool receiver at a location opposite a support shoulder; and a stretchable safety tether attached to the shoulder harness and having a connector to fasten to the hand tool, thereby allowing the user to retrieve and return the power hand tool to the tool receiver one handed.

2. The tool holder of claim 1 further comprising a belt connector attached to the shoulder harness near the lower end of the apex.

3. The tool holder of claim 1, wherein the tool receiver consists of an open hook.

4. The tool holder of claim 2, wherein the tool receiver consists of an open hook.

5. The tool holder of claim 2, wherein the shoulder harness further consists of a size adjustment means.

6. A tool holder comprising:

an adjustable shoulder harness having a lower apex near a user's hip;

a tool receiver consisting of an open hook attached to said lower apex suitable to support a power hand tool;

said shoulder harness consisting of a single shoulder sling functioning to hold the tool receiver at a location opposite a support shoulder;

a stretchable safety tether attached to the shoulder harness and having a connector to fasten to the hand tool, thereby allowing the user to retrieve and return the power hand tool to the tool receiver one handed; and a belt connector attached to the shoulder harness near the lower end of the apex.

7. A tool holder comprising:

a shoulder harness consisting of a single strap functioning to support on a single support shoulder a power hand tool at a users hip opposite the single support shoulder;

a tool holder functioning to support the power hand tool when not in use and to allow the user to remove and replace the power hand tool on the tool holder using only one hand; and a stretchable safety tether attached to the shoulder harness means and having a connector to fasten to the power hand tool.

8. The tool holder of claim 7 further comprising a belt connector attached to the shoulder harness near the tool holder.

9. The tool holder of claim 8, wherein the tool holder consists of an open hook.

* * * * *